United States Patent [19]

Storer

[11] 4,142,252

[45] Mar. 6, 1979

[54] ATHLETIC PROTECTIVE PAD DEVICE

[76] Inventor: John Storer, 3070 Mayfield Rd., Cleveland Heights, Ohio 44118

[21] Appl. No.: 837,845

[22] Filed: Sep. 29, 1977

[51] Int. Cl.[2] ..... A41D 13/06

[52] U.S. Cl. ..... 2/24; 2/16

[58] Field of Search ..... 2/2, 16, 22, 24, 62; 128/87 R, 89 R, 165

[56] References Cited

U.S. PATENT DOCUMENTS

| | | | |
|---|---|---|---|
| 2,657,385 | 11/1953 | Cushman et al. | 2/24 |
| 3,965,486 | 6/1976 | Lightbody | 2/24 |

*Primary Examiner*—Louis Rimrodt
*Assistant Examiner*—Moshe I. Cohen
*Attorney, Agent, or Firm*—Teare, Teare & Sammon

[57] ABSTRACT

The present invention relates generally to an athletic protective pad device, and more particularly relates to an improved construction for a prophylactic splint-like device of the type to be utilized by a participant in protecting the body in a contact sport, such as football or the like. In the invention, the device has specific application to protect the knee during periods of physical contact during playing the game of football.

3 Claims, 4 Drawing Figures

ATHLETIC PROTECTIVE PAD DEVICE

BACKGROUND OF THE INVENTION

As described, the present invention relates to an improved construction for a splint-like protective device, such as for the knee made of a compartmentalized construction adapted for pneumatic inflation, whereas to circumferentially support and protect the knee joint of the user.

Heretofore, the need for a device to protect the knee during periods of physical contact has been well recognized. The recent increasing incidents of serious knee injuries, particularly to the ligaments and supporting structures, provides ample evidence that such a device has not yet been satisfactorily perfected.

In the past, many various devices have been tried, but all have fallen short of achieving this goal. The simplest is the age old elastic support. This garment is virtually useless, giving no support to the ligamentous structures. Other devices have been used, such as inflatable splints, metal braces with straps and the like. These have been also of no significant benefit for several reasons. The inflatable splint, as formerly devised, may splint the knee and offers some protection, but as constructed, will not allow normal function of the knee joint. Straps and metal splints are limited in their protection and are cumbersome and somewhat dangerous because of the exposed metal parts.

Typical of prior art patents relating to this subject matter include U.S. Pat. Nos. 2,093,888, 2,657,385, 3,186,405, 3,454,963 and 3,823,712.

SUMMARY OF THE INVENTION

In the present invention, it has been found that in order for the splint-like device to be effective, it must:

1. Protect the knee joint during the most vulnerable period, i.e., complete extension;

2. Allow complete freedom of the knee joint so that flexion is not impeded.

The foregoing objects are accomplished in the present invention by a pneumatic splint-like device of compartmentalized construction comprising an inner section and an outer section. The inner section includes the plurality of pneumatically interconnected generally circular bundles extending generally radially of the knee joint, and an outer section including a plurality of pneumatically interconnected longitudinal bundles extending generally at right angles to the circular bundles whereby the knee joint is held in a splinted condition when in full extension by the longitudinal bundles so that upon flexion, pressure is displaced, by the initiation of flexion, into the circular bundles. By this arrangement, the inner circular bundles act as reservoirs, and return substantially a major portion of the pressure to the longitudinal bundles during extension of the knee joint. In the invention, this "synergistic action" is accomplished by constructing and arranging the longitudinal bundles of the outer section with a larger cross-sectional area and/or of a increased distensibility material compared to the material of the inner section of circular bundles. Conversely, pneumatic pressure is forced into the smaller, less distensible inner circular bundles upon flexion of the knee joint. In the invention, the inner and outer bundle sections are selectively inflated to the desired predetermined pneumatic pressure by a manifold and valve arrangement, as will be hereinafter fully described.

Moreover, it is an object of the present invention to provide a splint-like protective pad device which is sufficiently light weight, compact and flexible to enable full and easy flexion of the knee, such as during the course of running and jumping as played in body contact sports, such as football, soccer, basketball, hockey, or the like.

Further, another object of the present invention is to provide such improved device that will impart a generally uniform circumferential compression to the knee joint and so as not to impede arterial or venous circulation.

Another object of the present invention is to provide such device which is light weight but sufficiently strong to withstand rugged application. In addition, it is believed that the device should under most all conditions provide complete protection to the knee joint by virtue of its circumferential application and its longitudinal splinting, thus preventing the femur and tibia from being displaced in opposite directions during periods of physical trauma.

The features of the invention which are believed to be novel are set forth with particularity in the appended claims. The invention itself, however, both as to its organization and method of operation, together with further objects and features thereof may best be understood with reference to the following description taken in conjunction with the accompanying drawings.

DESCRIPTION OF THE PREFERRED EMBODIMENTS

Figure 1:
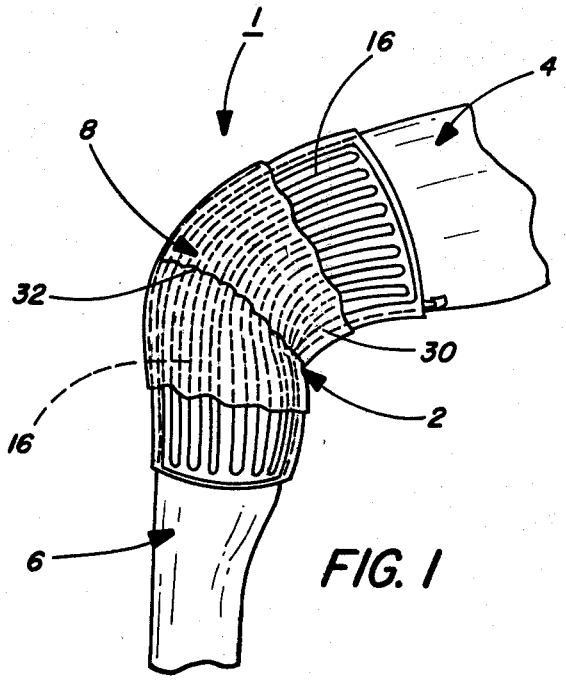
FIG. 1 is a fragmentary front elevation view of the splint-like device of the present invention as typically worn circumferentially around the knee joint extending from mid-thigh to mid-calf.
Figure 4:
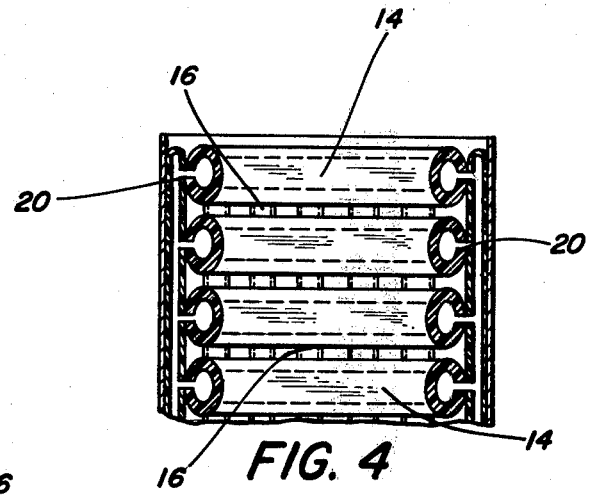
FIG. 4 is a longitudional section view taken along line 4—4 of FIG. 2.

Referring now again to the drawings and in particular to FIG. 1 thereof, there is illustrated the splint-like device of the present invention, designated generally at 1, illustrated for use by circumferential disposition around the knee-joint between mid-thigh and mid-calf. Specifically, the knee joint is illustrated at 2, the femur portion at 4, and the tibial portion at 6. The patella portion 8 is illustrated as circumferentially engaged by the device 1 in the flexed condition of the knee-joint shown in FIG. 1.

In accordance with the present invention, the device 1 comprises an inner section 10 and an outer section 12 which are integrally connected to provide a composite structure, preferably made from a flexible, high strength material. In the invention, it is preferred that the material be of a fabric made of neoprene impregnated nylon.

As shown, the inner section 10 comprised of a series of pneumatically inter connected generally circular bundles 14 which during normal use are disposed radially of the knee-joint in the extended condition thereof. As applied to the knee-joint, the circular bundles 14 are disposed in a generally concentric, stacked relationship to apply a circumferential pressure to the joint. Preferably, each of the tubes 14 has a diameter of approximately 1 centimeter, with the diameter being in the range between 0.8 centimeters and 1.2 centimeters. Also, it is preferred that the wall thickness of the material comprising the tubes 14 be approximately 2 millimeters. Preferably, the range in thicknesses between 1.9 millimeters and 2.1 millimeters. By this construction, the inner circular bundles have reduced flexion and, hence, act as reservoirs to absorb the return air flow from the outer section being an extension of the joint.

In the invention, the outer section 12 comprises a plurality of inter-connected longitudinal bundles 16 which extend at right angles to the inner bundles 14. The outer bundles 12 are arranged in a similar fashion, but extend longitudinally between the femur and tibia portions of the knee-joint so as to provide a splint-like structure extending circumferentially around the area of the joint to be protected. In this case, the diameter of the tube 16 is preferably 2 centimeters. Preferably, the diameter is arranged between 1.9 centimeters and 2.1 centimeters. Similarly, the wall thickness of the tubes is approximately 1 millimeter. Preferably, the thickness is between approximately 0.9 millimeter and 1.1 millimeters. Hence, the bundles 16 have a cross sectional area and/or are made of a reduced thickness material as compared to the cross sectional area and/or thickness of the material of the inner circular bundles 14. Hence, upon extension of the joint, air pressure flows outwardly from the inner bundles to the outer bundles until a pneumatic equilibrium condition is reached in relation to the predetermined inflation pressure of the device. Conversely, upon flexion of the knee, air pressure flows from the outer bundles 16 into the inner bundles 14 by an amount sufficient to enable the knee joint to bend to its normal extent. As understood, the principal axis of movement of the knee joint is in the transverse direction, thereby classifying the knee joint as a hinge-joint. It is known that the tibia and femur muscles are substantially more massive and stronger than the knee ligaments, which functionally interconnect the two at the knee joint. Hence, it is preferred that impact torque forces applied to the tibial portion be absorbed by the femur muscles which are more massive and stronger than the knee-joint ligaments, and hence more able to resist large impact forces commonly encountered in athletic events, such as football, soccer, basketball, hockey games, or the like. Hence, the device of the present invention acts to provide a generally uniform circumferential compression and support force to the knee-joint so as to divert the impact forces from the knee ligament to the femur and tibial portions which are better suited to absorb such forces.

Figure 2:
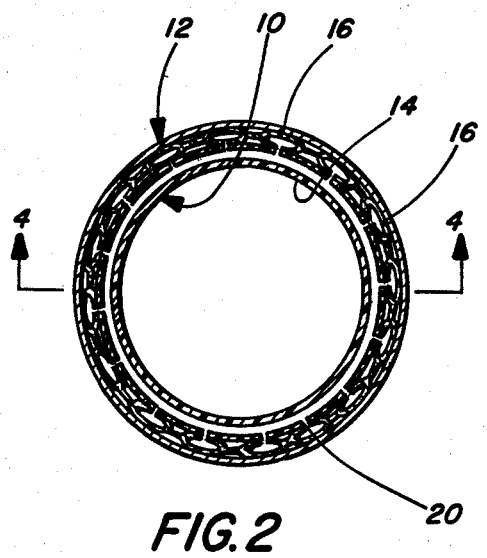
FIG. 2 is a horizontal section view of the splint-like device of the present invention taken through the line 2—2 of FIG. 1.
Figure 3:
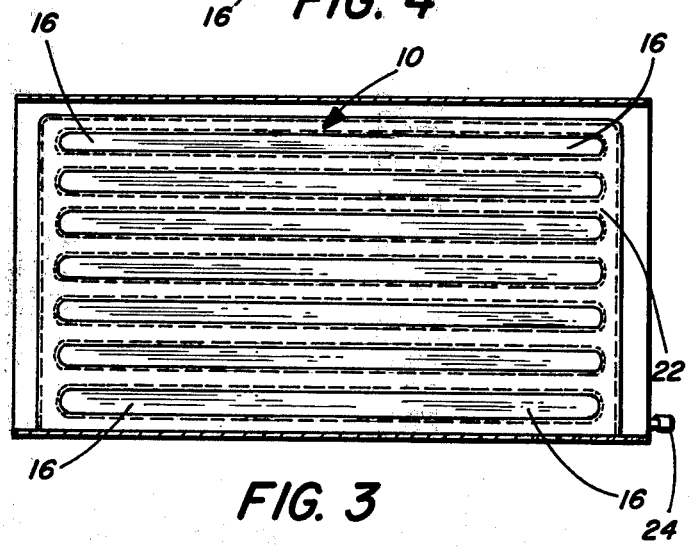
FIG. 3 is a side elevation view showing the splint-like device in the open condition looking at the side which comprises the outer section of longitudional bundles arranged in accordance with the present invention.

In the invention, the inner bundles 14 are pneumatically inter-connected to the outer bundles 16 by a series of equally spaced apertures, as at 20 (FIG. 2) which have a relatively small diameter of approximately 5 millimeters. The inner circular tubes 14, in turn, are connected at one end to a common manifold tube 22 (FIG. 3) which is provided with a valve 24 for simultaneously inflating both the inner 14 and outer 16 tubes via the common manifold 22. On the other hand, if desired, a separate manifold and valve arrangement could be provided for the inner and outer sections for independent inflation. Hence, in the invention, the inner 14 and outer 16 tubes are inflated to the same predetermined pressure, whereupon the valve 24 may be sealed for subsequent usage.

As shown, the device may be mounted interiorly beneath the material, as at 30, of the knee pad in a typical football uniform. In such application, a crease or sew line, as at 32, may be provided in the material of the outer section 12 in order to facilitate bending the device and hence, the knee joint.

I claim:

1. A pneumatic splint-like device of the type to be applied circumferentially around a portion of the body, such as the knee-joint, to provide support and protection and so as not to impede arterial or venous circulation therefor comprising, inner and outer sections made from a resilient fabric material, said inner section comprising a plurality of pneumatically inter-connected generally circular hollow tubes, said outer section comprising a plurality of pneumatically inter-connected longitudinal hollow tubes extending generally at right angles to said inner tubes, said inner circular and outer longitudinal tubes are pneumatically inter-connected by a plurality of apertures so as to be substantially simultaneously inflated to the same approximate pressure, and said outer longitudinal tubes having greater flexion characteristics than said inner circular tubes whereby said inner circular tubes act as air reservoirs so as to return excess pressure to said outer longitudinal bundles upon extension of said knee-joint.

2. A device made in accordance with claim 1, wherein said outer longitudinal tubes have a greater cross-sectional area as compared to the corresponding cross-sectional area of said inner circular tubes.

3. A device made in accordance with claim 1, wherein said outer longitudinal tubes have a reduced cross-sectional wall thickness as compared to the corresponding cross-sectional wall thickness of said inner circular tubes.

* * * * *